US007816647B2

(12) United States Patent
Agus

(10) Patent No.: US 7,816,647 B2
(45) Date of Patent: Oct. 19, 2010

(54) BI-DIRECTIONAL SYSTEM FOR MASS SPECTROMETRY

(75) Inventor: David B. Agus, Beverly Hills, CA (US)

(73) Assignee: Cedars-Sinai Medical Center, Los Angeles, CA (US)

( * ) Notice: Subject to any disclaimer, the term of this patent is extended or adjusted under 35 U.S.C. 154(b) by 290 days.

(21) Appl. No.: 11/816,899

(22) PCT Filed: Feb. 28, 2006

(86) PCT No.: PCT/US2006/006924

§ 371 (c)(1),
(2), (4) Date: Sep. 4, 2008

(87) PCT Pub. No.: WO2006/093901

PCT Pub. Date: Sep. 8, 2006

(65) Prior Publication Data

US 2009/0008546 A1 Jan. 8, 2009

Related U.S. Application Data

(60) Provisional application No. 60/657,037, filed on Feb. 28, 2005.

(51) Int. Cl.
*H01J 49/26* (2006.01)
*H01J 49/36* (2006.01)

(52) U.S. Cl. ..... 250/291; 250/281; 250/282; 250/285

(58) Field of Classification Search ..... 250/281, 250/282, 285, 288, 290, 291, 292, 293
See application file for complete search history.

(56) References Cited

U.S. PATENT DOCUMENTS

| | | | | |
|---|---|---|---|---|
| 5,455,418 | A * | 10/1995 | Hogan | 250/291 |
| 2003/0183760 | A1 * | 10/2003 | Tsybin et al. | 250/292 |
| 2005/0092919 | A1 * | 5/2005 | Bellec et al. | 250/290 |
| 2006/0169892 | A1 | 8/2006 | Baba et al. | |
| 2006/0232369 | A1 | 10/2006 | Gorshkov | |

* cited by examiner

*Primary Examiner*—Jack I Berman
*Assistant Examiner*—Nicole Ippolito Rausch
(74) *Attorney, Agent, or Firm*—Seth D. Levy; Davis Wright Tremaine LLP

(57) ABSTRACT

The present invention relates to a system and method for mass spectrometry (100) that allows for bi-directional introduction of collections of charged particles into the magnetic field of a mass spectrometer. More particularly, the present invention includes a system for mass spectrometry (100) (e.g., an FTMS mass spectrometer) with a cylindrical magnet (101) configured to receive and measure the cyclotron frequencies (104) of charged particles that are introduced (102, 103) into the cylindrical magnet (101) from either of the two axial ends thereof. Methods of the invention relate to performing mass spectrometry analysis on collections of charged particles that are introduced (102, 103), serially, simultaneously or both, into a cylindrical magnet (101) from opposing axial ends thereof. The present invention exhibits significantly increased magnet throughput relative to currently available devices, by allowing flow in the opposite direction to a second detector, e.g., during ion processing time of a first detector.

15 Claims, 2 Drawing Sheets

BI-DIRECTIONAL SYSTEM FOR MASS SPECTROMETRY

This application is the National Phase of International Application PCT/US06/06924, filed Feb. 28, 2006, which designated the U.S. and that International Application was published under PCT Article 21(2) in English. This application also includes a claim of priority under 35 U.S.C. §119(e) to U.S. provisional patent application No. 60/657,037, filed Feb. 28, 2005.

FIELD OF INVENTION

The invention relates to a system and method for mass spectrometry in which charged particles are directed into a magnetic field to determine various properties of the particles. Collections of charged particles are directed into the magnetic field in approximately opposing directions.

BACKGROUND OF THE INVENTION

In conventional ion cyclotron resonance ("ICR") mass spectrometers, such as those typically used in connection with Fourier Transform Mass Spectrometry ("FTMS"), charged particles are directed into a magnetic field such that various properties of the particles can be measured. In one application of this technology, as described in U.S. Pat. No. 4,959,543, which is incorporated by reference herein in its entirety, charged particles are subjected to a high voltage pulse and caused to be accelerated to larger radii of gyration relative to the particles' natural radii of gyration. Once excited in this fashion, the charged particles move in circular orbits at frequencies given by the cyclotron equation, $\omega=qB/m$ (where B is the magnetic field strength and q/m is the charge-to-mass ratio of the particles). The excited cyclotron motions induce transient signals on a pair of parallel electrodes positioned inside the magnet; the transient signals are a measure of the cyclotron frequency of the particles. In fact, the transient signals are actually a composite of the cyclotron frequencies of all of the ions present in the magnet. By implementing certain Fourier transform mathematics (e.g., a Fast Fourier Transform, or "FFT," algorithm to extract the frequency and amplitude for each frequency component), these transient signals are converted into an m/z (mass/charge) plot that can be displayed as a mass spectrum.

There are a number of commercially available products that implement this technique; by way of example, the QFT-7 Hybrid Mass Spectrometer, the HiResMALDI FT Mass Spectrometer, the HiResESI FT Mass Spectrometer, and Explorer FT Mass Spectrometer (all available from IonSpec Corporation; Lake Forest, Calif.). Other similar devices are available from Applied Biosystems (Foster City, Calif.), Bruker Daltonics (Billerica, Mass.), and Waters Corporation, under the Micromass® MS Technologies trade name (Milford, Mass.).

A significant limitation of this technology, and of the aforementioned products that implement it, is system efficiency. Conventional FTMS mass spectrometers are configured with a large cylindrical magnet. This is required to produce a uniform magnetic field, and to thereby provide an environment in which charged particles can be provoked to move in circular orbits whose frequencies can be readily measured with the aforementioned technique. However, these devices are configured to only introduce charged particles through one axial end of the cylindrical magnet.

Furthermore, the uni-directional flow implemented in these systems, and which is standard in each presently available mass spectrometer, allows for an ion flow to go through the magnet to a detector, but a significant time gap follows during which the information read by the detector is processed by the system. It is only after this time gap that the detector is ready to receive the next ion measurement.

There is thus a need in the art for an improved system for mass spectrometry that obviates at least some of these limitations of currently available technology.

SUMMARY OF THE INVENTION

Embodiments of the invention disclosed herein provides a bi-directional ion cyclotron resonance mass spectrometry system comprising a cylindrical magnet comprising a first axial end, a second axial end, and an enclosed cavity therebetween; a first sample introduction mechanism at the first axial end; a second sample introduction mechanism at the second axial end; and a cyclotron frequency measurement device configured within the cylindrical magnet, and having one or more pairs of ion trapping plates, wherein the first and second sample introduction mechanisms are configured to introduce samples of charged particles into the enclosed cavity through the first and second axial ends of the cylindrical magnet, respectively.

Further embodiments provide ion cyclotron resonance mass spectrometry systems wherein the first and second sample introduction mechanisms further comprise an ionization mechanism.

Still further embodiments provide for an ion cyclotron resonance mass spectrometry system wherein the ionization mechanisms are selected from the group consisting of matrix-assisted laser desorption ionization, electrospray ionization, electron impact ionization, and combinations thereof.

Additional embodiments of the invention provide ion cyclotron resonance mass spectrometry systems further comprising a second cyclotron frequency measurement device.

Other embodiments of the invention provide ion cyclotron resonance mass spectrometry systems wherein the first and second sample introduction mechanisms are configured to introduce charged particles into the enclosed cavity at an interval selected from the group consisting of serially, simultaneously, and combinations thereof.

Embodiments of the invention provide for a bi-directional ion cyclotron resonance mass spectrometry system, comprising: a cylindrical magnet comprising a first axial end, a second axial end, and an enclosed cavity therebetween, a means to introduce a sample of charged particles at the first axial end of the cylindrical magnet, a means to introduce a sample of charged particles at the second axial end of the cylindrical magnet, and a means to measure the cyclotron frequency of charged particles introduced into the cylindrical magnet, located within the enclosed cavity.

Further embodiments provide a bi-directional ion cyclotron resonance mass spectrometry system wherein the means to introduce a sample of charged particles at the first axial end and the means to introduce a sample of charged particles at the first second end each further comprise a means to ionize particles in a sample.

Still further embodiments provide a bi-directional ion cyclotron resonance mass spectrometry system further comprising a second means to measure the cyclotron frequency of charged particles introduced into the cylindrical magnet.

Other embodiments of the invention provide methods of upgrading a uni-directional ion cyclotron resonance mass spectrometer to a bi-directional ion cyclotron resonance mass spectrometer, comprising providing a uni-directional ion cyclotron resonance mass spectrometer comprising a first axial end, a second axial end, and an enclosed cavity therebetween, providing a supplemental sample introduction mechanism; and configuring the supplemental sample introduction mechanism with the uni-directional ion cyclotron resonance mass spectrometer such that samples of charged particles may be introduced into the first axial end and the second axial end of the enclosed cavity.

Additional embodiments of the invention provide methods of creating protein profiles based on multiple serum samples, comprising providing a bi-directional ion cyclotron resonance mass spectrometry system, comprising a cylindrical magnet comprising a first axial end, a second axial end, and an enclosed cavity therebetween, a first sample introduction mechanism at the first axial end, a second sample introduction mechanism at the second axial end, and a cyclotron frequency measurement device configured within the cylindrical magnet, and having one or more pairs of ion trapping plates, wherein the first and second sample introduction mechanisms are configured to introduce samples of charged particles into the enclosed cavity through the first and second axial ends of the cylindrical magnet, respectively; introducing a first serum sample at the first axial end; introducing a second serum sample at the second axial end; and obtaining a protein profile for each of the first and second serum samples.

DETAILED DESCRIPTION OF THE INVENTION

Figure 1:
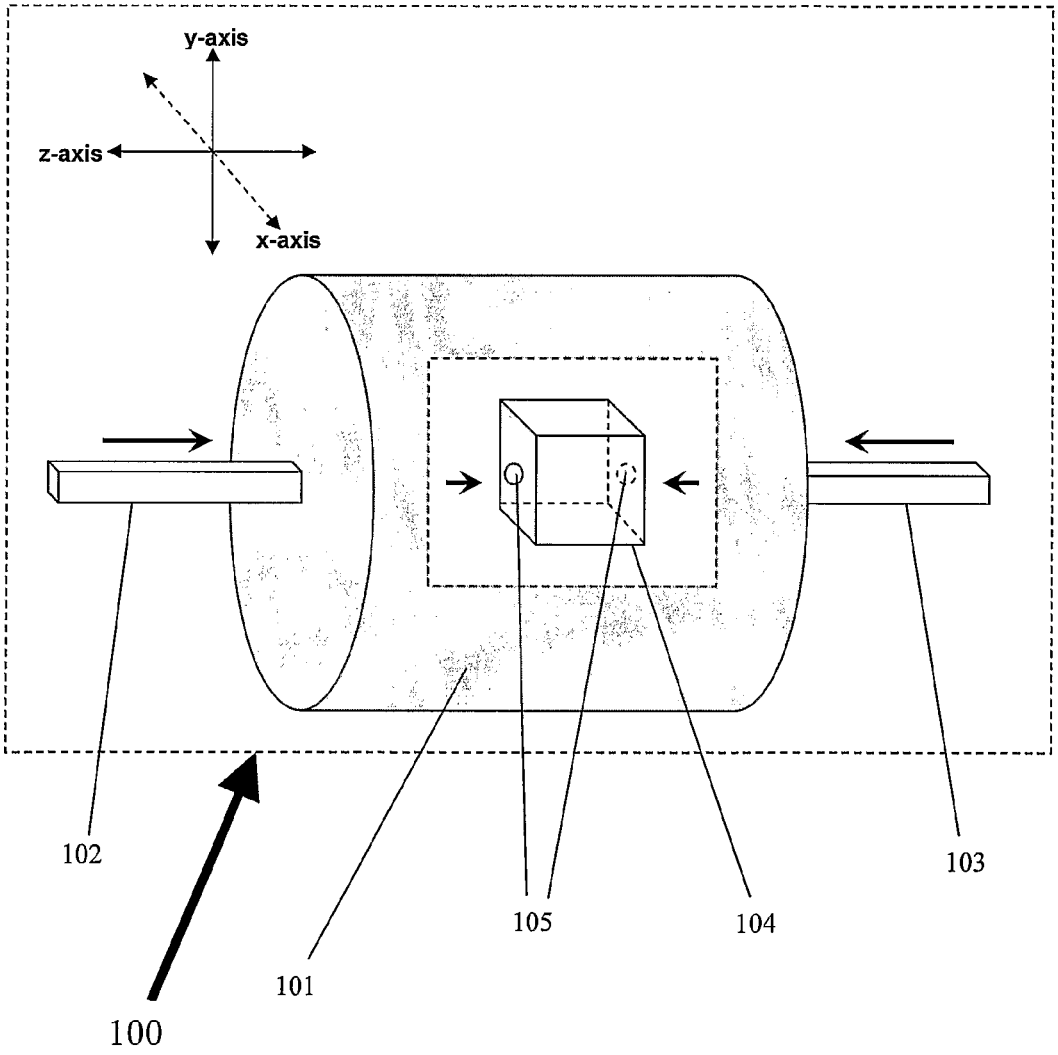
FIG. 1 illustrates an elevational view of a mass spectrometer with a cylindrical magnet in accordance with an embodiment of the present invention. The cylindrical magnet is adapted to receive collections of charged particles from both axial ends thereof.

Unless defined otherwise, technical and scientific terms used herein have the same meaning as commonly understood by one of ordinary skill in the art to which this invention belongs. One skilled in the art will recognize many methods and materials similar or equivalent to those described herein, which could be used in the practice of the present invention. Indeed, the present invention is in no way limited to the methods and materials described.

The invention disclosed herein provides a means of increasing the throughput of Fourier Transform mass spectrometry (FTMS) systems by introducing charged particles into the FTMS system from both ends of the system, i.e., bi-directionally. Ion cyclotron resonance mass spectrometry is a type of FTMS. Aspects of the invention relate to a system wherein a cylindrical magnet is used to create an at least approximately uniform magnetic field. Such systems are commonly used in the art of FTMS; for instance, in the analysis of proteins and peptides. As one of skill in the art will readily recognize, there are a number of variations on the conventional configuration of a mass spectrometer, and a number of different commercial products are available.

Common to these systems is the use of a large, cylindrical, superconducting magnet to create a magnetic field through which collections of charged particles are artificially provoked to travel. The magnets used in connection with this technology are typically solenoidal, and comprise a hollow cylindrical core along a central axis (designated the Z axis). When a current is applied to the solenoid, a magnetic field is produced that is characterized by lines of magnetic flux that are approximately parallel to the cylindrical core. Upon introduction into the cylindrical core and exposure to a magnetic field, charged particles (such as electrons or ions) that are formed along any of the magnetic flux lines have their movement restricted in the directions perpendicular to that particular flux line. These directions are often referred to as the X axis and Y axis directions.

Movement of the charged particles along the flux line is not restricted and is related to the thermal energy of the particle and any applied accelerating fields. Upon exposure to the magnetic field, charged particles generally undergo orbital motion within the plane defined by the X axis and the Y axis (perpendicular to the flux line). This orbital motion (cyclotron motion) is known and the radius of the orbital motion is directly proportional to the mass and component of energy of the particle in the X,Y plane perpendicular to the flux line and inversely proportional to the strength of the magnetic field. The solenoidal magnet also has two axial ends that are oriented perpendicular to the central cylindrical core in an X,Y plane through which charged particles may be introduced.

Magnets used for this application are typically of from about 4.0 T to about 12.0 T, although magnets of greater or lesser flux density may be used in connection with alternate embodiments of the present invention and are contemplated as being within the scope thereof. Inside the central cylindrical core of the magnet, at least in connection with ICR mass spectrometry, the cyclotron frequencies of charged particles are measured. From that information, a mass spectrum of the components of a collection of charged particles can be displayed. In one implementation of this technology, protein identification is performed (e.g., by protein mass fingerprinting, ion dissociation, etc.). Certain aspects of the invention provide a means of introducing samples comprising ions or charged particles into a magnetic field through either or both axial ends of a cylindrical magnet, and/or utilizing multiple regions within the magnet. These methods permit the analysis of multiple samples simultaneously and therefore improve the throughput and efficiency of FTMS systems.

Analysis of the samples may occur by use of a cyclotron frequency measurement device that is located within the magnetic field. In certain embodiment of the invention, the cyclotron frequency measurement device is ICR cell, which may also be referred to as an analyzer cell. The ICR cell or analyzer cell may have one or more pairs of electrode "plates" (also referred to as "trapping plates") that function to manipulate ions, trap ions, and/or detect ions.

Bi-directional FTMS systems allow for samples of charged particles to be introduced into both ends of the cylindrical core of the magnet where their cyclotron frequencies may be measured. Following cyclotron frequency measurement, there is a significant time gap while the information collected by the detector is processed by the system. Bi-directional introduction of charged particles through both ends of the system allows a second sample to be injected while the previous sample is being processed. Such an arrangement may allow for an increase in the throughput of the instrument.

The inventive bi-directional FTMS system comprises two separate sample introduction mechanisms, which may also be referred to as "charged particle introduction pathways"; one at each axial end of the magnet. The sample introduction mechanism further comprises an ion source or ionization mechanism. There are a number of methods known in the art that are useful for producing charged particles suitable for FTMS analysis. Examples of ion sources include but are not limited to matrix-assisted laser desorption/ionization ("MALDI") sources, electron impact ("EI") sources, and electrospray ionization ("ESI") sources. A suitable ion source component is one that can introduce charged particles into the magnet of a mass spectrometer. Further, a bi-directional FTMS system may comprise two different ion sources in the same instrument.

As illustrated in FIG. 1, a system for mass spectrometry 100 includes a cylindrical magnet 101, which may be integrated with the remaining components of a mass spectrometer or mass spectrometry system, as will be readily appreciated by those of skill in the art. The mass spectrometer may be an FTMS mass spectrometer, or any other mass spectrometer that incorporates a cylindrical magnet similar to that used in connection with FTMS mass spectrometry.

The cylindrical magnet 101 is configured to receive collections of charged particles from both axial ends thereof, via sample introduction mechanisms 102 and 103. The sample introduction mechanisms 102, 103 may incorporate any number of components typically used to introduce charged particles into the magnet of a mass spectrometer. By way of example, the sample introduction mechanisms 102, 103 may further comprise ionization mechanisms that may be independently selected from MALDI, ES, ESI, and/or any number of other suitable components.

The system 100 may further include a cyclotron frequency measurement apparatus 104 configured inside the cylindrical magnet 101. The cyclotron frequency measurement apparatus 104 measures the cyclotron frequency of a collection of charged particles that is introduced into the cylindrical magnet 101. In one embodiment of the invention, the cyclotron frequency measurement apparatus 104 includes a pair of parallel electrodes, upon which transient signals that are a measure of the cyclotron frequency of the particles are induced. The cyclotron frequency measurement apparatus 104 may optionally include a pair of ports 105 to provide access to the interior thereof by collections of charged particles that are introduced into the cylindrical magnet 101. The ports 105 may be of any convenient size or configuration; the ports 105 need not be identical to one another.

Figure 2:
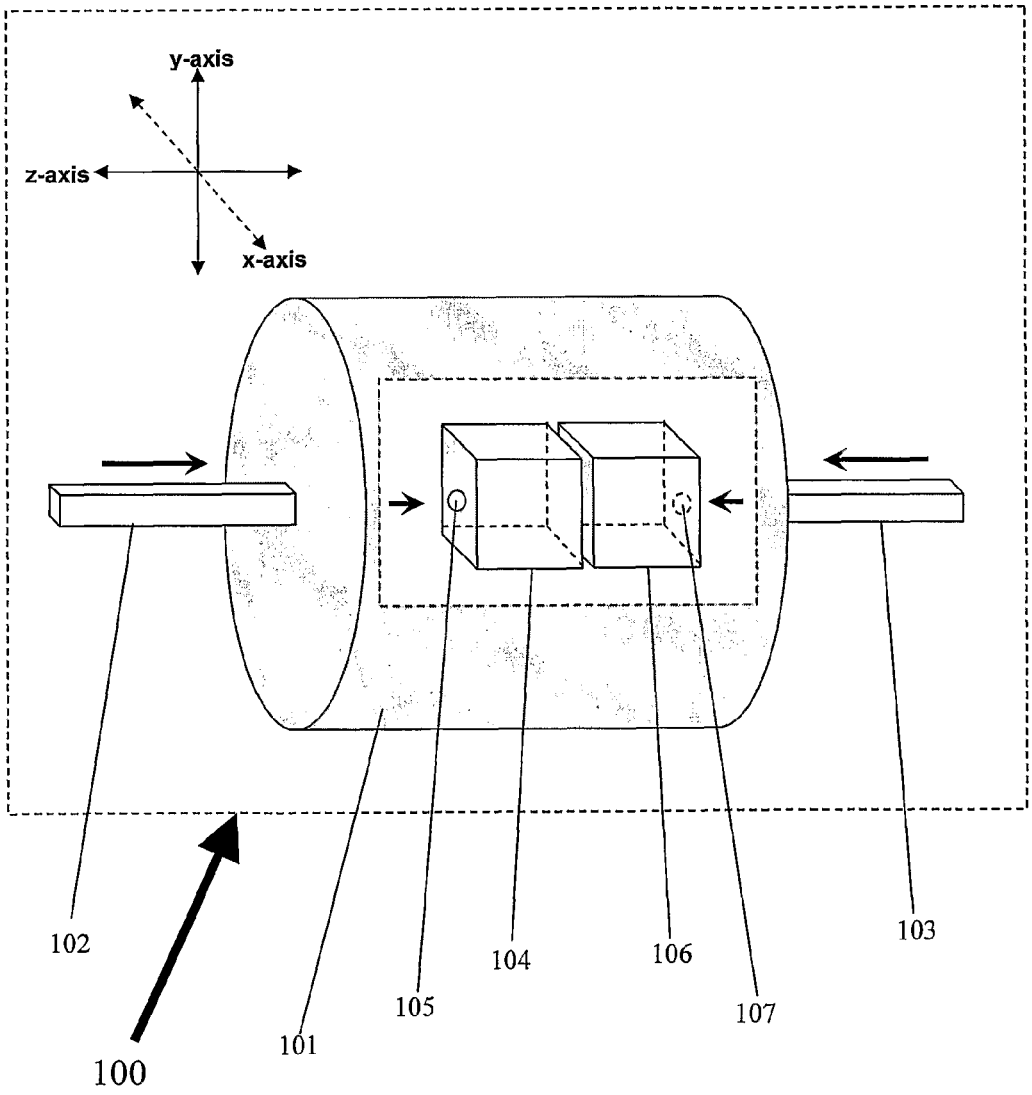
FIG. 2 shows an elevational view of a mass spectrometer with two cyclotron frequency measurement mechanisms in accordance with an embodiment of the present invention.

FIG. 2 shows a system for mass spectrometry comprising two cyclotron frequency measurement mechanisms. The second mechanism 106 may also have a port 107 to provide access to the interior thereof by collections of charged particles.

The system 100 may also include various electronics, computer components, and an array of further machinery (not shown) that are well known to those of skill in the art to allow the performance of mass spectroscopic analysis on a collection of charged particles.

The sample introduction mechanisms 102, 103 may be used serially (i.e., to introduce a collection of charged particles from one axial end of the cylindrical magnet 101, then to introduce a collection of charged particles from the other axial end of the cylindrical magnet 101, and so on), simultaneously (i.e., to introduce collections of charged particles from both axial ends of the cylindrical magnet 101 at the same time) or in any other chronologic combination to perform mass spectroscopic analysis on one or more collections of charged particles. Notably, in embodiments of the present invention wherein the introduction of charged particles occurs simultaneously, the incorporation of a second cyclotron frequency measurement apparatus (not shown), or ICR cell, may be advantageous. Indeed, a second ICR cell may be advantageous in other embodiments of the present invention as well. In fact, the present invention may exhibit significantly increased magnet throughput, relative to currently available devices, by allowing flow in the opposite direction to a second cyclotron frequency measurement apparatus, e.g., during ion processing time of a first cyclotron frequency measurement apparatus.

In particular embodiments of the invention, two ICR cells are inserted into a single magnet (i.e., each configured 180° from the other, facing opposing ends of a cylindrical magnet), and samples are introduced independently, with respect to each cell. This may double system efficiency, as data from two samples may be obtained in one magnet with two detectors. This may be particularly advantageous in terms of system scale-up. In other embodiments of the invention, a single ICR cell may be configured to receive samples introduced from either end of the magnet.

Most modern FTMS systems are "uni-directional", as they comprise a magnet with a single ICR cell and a single sample introduction mechanism which is used to introduce samples of charged particles into one end of the magnet. However, it is within the scope of the invention to modify, retro-fit, or adapt a uni-directional FTMS system to produce a bi-directional system. Such an a modification would involve the installation of a supplemental sample introduction mechanism into an existing uni-directional system. Additionally, a uni-directional system could be modified to contain a second cyclotron frequency measurement mechanism, for example, an ICR cell.

Alternatively, the invention as contemplated herein encompasses a FTMS system wherein multiple ion samples are introduced into a single ICR simultaneously. The signals produced by the orbiting ions in the ICR may then be deconvolved to determine which signals came from which samples.

In yet another alternative design, a "machine gun" ionization spray may be used to rapidly fire different ion samples into a single magnet. Portions of a sample may be fired into regions of a magnet other than or in addition to the magnet's absolute center. In this manner, many samples or portions of a sample may be analyzed simultaneously. For example, the molecular dynamic range or m/z ratio range may be divided into arbitrary units, and each unit range can be fired into a different region of the magnet (e.g. Range #1 fired at Region #1, Range #2 fired at Region #2, etc.). While the raw data obtained from such a procedure is distorted, the distortion is predictable, because each sample portion of a particular range is always fired into the same region in the magnet. Thus, the distortion is accounted for with an appropriate mathematical correction. By way of example, wherein orbits are perfectly elliptical, the detected cyclotron signal data is transformed into mass spectra by applying elliptical functions rather than the spherical functions of the basic forward Fourier transform. A bi-directional apparatus may be used in conjunction with a "machine gun" type apparatus. The equations relating frequency to m/z ratio would be unchanged. For embodiments wherein multiple samples are introduced into a single magnet, separate detection plates within a single ICR cell may be used to aid in signal de-convolution.

A bi-directional FTMS system may be used to analyze many different types of samples and compounds. One application for a bi-directional FTMS such as the one disclosed herein is to analyze protein samples, such as samples from plasma or serum. A bi-directional system could be used in conjunction with a system for patient data and treatment management such as disclosed in WO2006/002415.

While the description above refers to particular embodiments of the present invention, it should be readily apparent to people of ordinary skill in the art that a number of modifications may be made without departing from the spirit thereof.

The presently disclosed embodiments are, therefore, to be considered in all respects as illustrative and not restrictive.

What is claimed is:

1. A bi-directional ion cyclotron resonance mass spectrometry system, comprising:

a cylindrical magnet comprising a first axial end, a second axial end, and an enclosed cavity therebetween;

a first sample introduction mechanism at the first axial end;

a second sample introduction mechanism at the second axial end; and a cyclotron frequency measurement device configured within the cylindrical magnet, and having one or more pairs of ion trapping plates, wherein the first and second sample introduction mechanisms are configured to introduce samples of charged particles into the enclosed cavity through the first and second axial ends of the cylindrical magnet, respectively.

2. The ion cyclotron resonance mass spectrometry system of claim 1, wherein the first sample introduction mechanism further comprises an ionization mechanism.

3. The ion cyclotron resonance mass spectrometry system of claim 2, wherein the ionization mechanism is selected from the group consisting of matrix-assisted laser desorption ionization, electrospray ionization, electron impact ionization, and combinations thereof.

4. The ion cyclotron resonance mass spectrometry system of claim 1, wherein the second sample introduction mechanism further comprises an ionization mechanism.

5. The ion cyclotron resonance mass spectrometry system of claim 4, wherein the ionization mechanism is selected from the group consisting of matrix-assisted laser desorption ionization, electrospray ionization, electron impact ionization, and combinations thereof.

6. The ion cyclotron resonance mass spectrometry system of claim 1, further comprising a second cyclotron frequency measurement device.

7. The ion cyclotron resonance mass spectrometry system of claim 1, wherein the first and second sample introduction mechanisms are configured to introduce charged particles into the enclosed cavity at an interval selected from the group consisting of serially, simultaneously, and combinations thereof.

8. The ion cyclotron resonance mass spectrometry system of claim 1, wherein the first and second sample introduction mechanisms are configured to serially introduce charged particles into the enclosed cavity.

9. The ion cyclotron resonance mass spectrometry system of claim 1, wherein the first and second sample introduction mechanisms are configured to simultaneously introduce charged particles into the enclosed cavity.

10. A bi-directional ion cyclotron resonance mass spectrometry system, comprising:

a cylindrical magnet comprising a first axial end, a second axial end, and an enclosed cavity therebetween;

means to introduce a sample of charged particles at the first axial end of the cylindrical magnet;

means to introduce a sample of charged particles at the second axial end of the cylindrical magnet, and means to measure the cyclotron frequency of charged particles introduced into the cylindrical magnet, located within the enclosed cavity.

11. The bi-directional ion cyclotron resonance mass spectrometry system of claim 10, wherein the means to introduce a sample of charged particles at the first axial end and the means to introduce a sample of charged particles at the first second end each further comprise a means to ionize particles in a sample.

12. The bi-directional ion cyclotron resonance mass spectrometry system of claim 10, further comprising a second means to measure the cyclotron frequency of charged particles introduced into the cylindrical magnet.

13. A method of upgrading a uni-directional ion cyclotron resonance mass spectrometer to a bi-directional ion cyclotron resonance mass spectrometer, comprising:

providing a uni-directional ion cyclotron resonance mass spectrometer comprising a cylindrical magnet comprising a first axial end, a second axial end, and an enclosed cavity therebetween;

providing a supplemental sample introduction mechanism; and configuring the supplemental sample introduction mechanism with the uni-directional ion cyclotron resonance mass spectrometer such that samples of charged particles may be introduced into the first axial end and the second axial end of the enclosed cavity.

14. A method of creating protein profiles based on multiple serum samples, comprising:

providing a bi-directional ion cyclotron resonance mass spectrometry system, comprising:

a cylindrical magnet comprising a first axial end, a second axial end, and an enclosed cavity therebetween, a first sample introduction mechanism at the first axial end, a second sample introduction mechanism at the second axial end, and a cyclotron frequency measurement device configured within the cylindrical magnet, and having one or more pairs of ion trapping plates, wherein the first and second sample introduction mechanisms are configured to introduce samples of charged particles into the enclosed cavity through the first and second axial ends of the cylindrical magnet, respectively;

introducing a first serum sample at the first axial end;

introducing a second serum sample at the second axial end; and obtaining a protein profile for each of the first and second serum samples.

15. A bi-directional ion cyclotron resonance mass spectrometry system, comprising:

a cylindrical magnet comprising a first axial end, a second axial end, and an enclosed cavity therebetween;

a first sample introduction mechanism at the first axial end;

a second sample introduction mechanism at the second axial end; and a cyclotron frequency measurement device configured within the cylindrical magnet, and having one or more pairs of ion trapping plates, wherein the first sample introduction mechanism, the second sample introduction mechanism, or both are configured to introduce samples into multiple regions within the enclosed cavity.

* * * * *